US011329437B2

(12) United States Patent
Hu

(10) Patent No.: US 11,329,437 B2
(45) Date of Patent: May 10, 2022

(54) INSERTION DETECTION DEVICE FOR PLUG PINS AND A SAFETY SOCKET

(71) Applicant: Feifan Hu, Guangdong (CN)

(72) Inventor: Feifan Hu, Guangdong (CN)

( * ) Notice: Subject to any disclaimer, the term of this patent is extended or adjusted under 35 U.S.C. 154(b) by 385 days.

(21) Appl. No.: 16/629,974

(22) PCT Filed: Jul. 10, 2017

(86) PCT No.: PCT/CN2017/092397
§ 371 (c)(1),
(2) Date: Jan. 10, 2020

(87) PCT Pub. No.: WO2019/010613
PCT Pub. Date: Jan. 17, 2019

(65) Prior Publication Data

US 2020/0136321 A1 Apr. 30, 2020

(51) Int. Cl.

| | |
|---|---|
| ***H01R 13/703*** | (2006.01) |
| ***H01R 13/447*** | (2006.01) |
| ***H01R 13/52*** | (2006.01) |
| ***H01R 13/713*** | (2006.01) |
| ***H01R 24/76*** | (2011.01) |

(52) U.S. Cl.
CPC ..... *H01R 13/703* (2013.01); *H01R 13/447* (2013.01); *H01R 13/521* (2013.01); *H01R 13/713* (2013.01); *H01R 24/76* (2013.01)

(58) Field of Classification Search
CPC .. H01R 13/703; H01R 13/447; H01R 13/521; H01R 13/713; H01R 24/76; H01R 13/453; H01R 13/4534
See application file for complete search history.

(56) References Cited

U.S. PATENT DOCUMENTS

| | | | | |
|---|---|---|---|---|
| 5,928,019 A * | 7/1999 | Chen | H01R 13/7031 | 200/51.09 |
| 6,111,210 A * | 8/2000 | Allison | H01R 13/7036 | 200/51.09 |
| 7,452,221 B1 * | 11/2008 | Oddsen | H01R 13/4534 | 439/140 |
| 8,616,904 B1 * | 12/2013 | Martin | H01R 13/4534 | 439/188 |

(Continued)

FOREIGN PATENT DOCUMENTS

| | | |
|---|---|---|
| CN | 204103162 U | 1/2015 |
| CN | 104380538 A | 2/2015 |

(Continued)

*Primary Examiner* — Tho D Ta

(57) ABSTRACT

An insertion detection device for plug pins in a socket and a safety socket. A connecting rod trigger assembly of the insertion detection device forms a linkage structure with a first elastic conductive connector. When the connecting rod trigger assembly moves from the conduction section to the disconnection section, it can ensure that the first elastic conductive connector and the second conductive connector are disconnected. Even if the first elastic conductive connector is deformed due to prolonged insertion of plug, it can be separated from the second conductive connector by moving the connecting rod trigger assembly, and its internal circuit is always in disconnected state. At least three insertion detection devices of the safety socket correspond to two pins of live wire and neutral wire.

10 Claims, 5 Drawing Sheets

(56) References Cited

U.S. PATENT DOCUMENTS

| | | | | |
|---|---|---|---|---|
| 2012/0100734 | A1* | 4/2012 | Wang | H01R 13/703<br>439/188 |
| 2017/0085022 | A1* | 3/2017 | Zhang | H01R 13/4534 |

FOREIGN PATENT DOCUMENTS

| | | | |
|---|---|---|---|
| CN | 207165857 | U | 3/2018 |
| JP | 2005063766 | A | 3/2005 |
| JP | 2010056055 | A | 3/2010 |
| WO | 2016088869 | A1 | 6/2016 |

* cited by examiner

INSERTION DETECTION DEVICE FOR PLUG PINS AND A SAFETY SOCKET

TECHNICAL FIELD

The present disclosure relates to a socket, in particular to an insertion detection device for plug pins in socket.

BACKGROUND

The traditional socket has great potential safety hazard for children without safety awareness. The existing safety socket is provided with a safety device, but has defects in reliability and safety.

For example, in a safety socket (CN204103162U) disclosed on Jan. 14, 2015, the live and neutral insertion & holding assembly has two rotating blocks respectively, corresponding to the narrow surface of the flat pin, and when the four rotating blocks are touched by the narrow surface of the pin, electricity is supplied. There is no requirement for sequence and time difference, and power will be supplied as long as it is touched, thus lacking safety.

For example, in a safety socket and its application (CN104380538A) disclosed on Feb. 25, 2015, a mechanical push rod and a lock control mechanism are adopted to safely switch on the power supply for the socket, which requires high mechanical structure. As long as the mechanical push rods in the live and neutral slot simultaneously touch the switch device, the power supply for the socket can be switched on. In this case, the switch device can be pried through two insertion sheets narrower than standard pins, thereby simultaneously triggering the switch device, which is unreliable and unsafe.

SUMMARY

The present disclosure provides an insertion detection device for plug pins in socket and a safety socket.

According to an aspect of the present application, an embodiment provides an insertion detection device for plug pins in a socket, wherein the socket comprises a main body frame, and the insertion detection device is installed on the main body frame of the socket, further comprising:

a first elastic conductive connector bracket, the first elastic conductive connector bracket is installed on the main body frame of the socket;

a first elastic conductive connector, the first elastic conductive connector is installed on the first elastic conductive connector bracket;

a second conductive connector; and a connecting rod trigger assembly including a connecting rod, a connecting rod shaft and an elastic reset piece, the connecting rod shaft is installed on the main body frame, the connecting rod is rotatably installed on the connecting rod shaft, the elastic reset piece is connected with the connecting rod to provide acting force for resetting the connecting rod; the connecting rod comprises a trigger endface and a trigger end, wherein the trigger endface is at least partially positioned on an insertion path of a pin, so that when the pin is inserted, the connecting rod is prompted to rotate around the connecting rod shaft; the trigger end has a conduction section and a disconnection section on its motion stroke, the trigger end and the first elastic conductive connector form a linkage structure, so that the first elastic conductive connector moves at least partially along with the trigger end, when the trigger end is located in the conduction section, the first elastic conductive connector is communicated with the second conductive connector, and when the trigger end is located in the disconnection section, the second conductive connector is disconnected with the first elastic conductive connector.

As a further improvement of the insertion detection device, the linkage structure further comprises a pull-back piece, the pull-back piece is installed at the trigger end, and a hook, the hook is formed on the side of the first elastic conductive connector away from the trigger end, when the trigger end moves from the conduction section to the disconnection section, the pull-back piece hooks the first elastic conductive connector to disconnect it from the second conductive connector.

As a further improvement of the insertion detection device, the pull-back piece is rotatably installed on the trigger end.

As a further improvement of the insertion detection device, a retaining rebar is arranged on the side of the first elastic conductive connector facing away from the second conductive connector, and the retaining rebar forms a limit on a side of the first elastic conductive connector.

According to one aspect of the present application, an embodiment provides a safety socket, comprising:

a main body frame defining a pin receiving cavity, wherein the pin receiving cavity comprises a live pin receiving cavity and a neutral pin receiving cavity, and is used for plug pins to insert;

a upper cover plate, covered on the main body frame, and the upper cover plate has a pin-guide hole corresponding to the pin receiving cavity;

a conductive connection end, correspondingly arranged in the pin receiving cavity and used for being connected with an inserting pin;

a control circuit, the conductive connection end is connected with the control circuit, and the control circuit controls the on-off of the conductive connection end; and at least three insertion detection devices as described above, wherein in the live pin receiving cavity and the neutral pin receiving cavity, one is correspondingly provided with at least two insertion detection devices, the other is correspondingly provided with at least one insertion detection device; the first elastic conductive connector and the second conductive connector of the insertion detection device are respectively communicated with the control circuit, and the trigger endface of the connecting rod in the insertion detection device is at least partially positioned on the insertion path of a pin, the connecting rod trigger assembly can be driven to move from the disconnection section to the conduction section in the process of inserting the pin into the pin receiving cavity, so that the first elastic conductive connector and the second conductive connector are communicated to generate a conduction signal, the conduction signal is used as a pin insertion detection signal of the control circuit; the control circuit determines whether all pin insertion detection signals enter the control circuit within a set first time difference, if yes, the control circuit controls the conductive connection end to be electrified, if no, the control circuit prohibits the conductive connection end from being electrified.

As a further alternative to the safety socket, the connecting rod trigger assembly is arranged on the wider side of the pin receiving cavity, so that the edge of wide surface of the pin acts on the trigger endface of the connecting rod.

As a further alternative to the safety socket, it also comprises a lower cover plate, a liquid accumulation chamber enclosed between the lower cover plate and the main body frame, and an opening arranged at the bottom of the pin receiving cavity, the bottom of the pin receiving cavity inclines to the opening, the pin receiving cavity is communicated with the liquid accumulation chamber through the opening, the lower cover plate and the main body frame are detachably installed to facilitate opening the liquid accumulation chamber.

As a further alternative to the safety socket, the liquid accumulation chambers corresponding to different pin receiving cavities are sealed and separated from each other.

As a further alternative to the safety socket, the safety socket further comprises a light sensor, wherein the upper cover plate of the safety socket is provided with at least one light inlet window and a light guide piece, the light guide piece guides the light of the light inlet window to the light sensor, the light inlet window is arranged in the coverage area of a standard plug, the light sensor is used for detecting whether the light inlet window is blocked, the control circuit determines whether all pin insertion detection signals enter the control circuit within a set first time difference, if no, the control circuit prohibits the conductive connection end from being powered on; if yes, it continues to determine whether the light inlet window blocked signal detected by the light sensor enters the control circuit within a set second time difference, if yes, the control circuit controls the conductive connection end to be powered on, if no, the control circuit prohibits the conductive connection end from being powered on.

As a further alternative to the safety socket, the safety socket comprises at least one plug chamber and a DC output connection terminal arranged in the plug chamber, and the plug chamber is obliquely arranged to the opening; the DC output connection terminal is electrically connected with the control circuit.

The present disclosure has the following beneficial effects:

According to the insertion detection device in the above embodiments, the connecting rod trigger assembly of the insertion detection device and the first elastic conductive connector form a linkage structure, so that the first elastic conductive connector can move along with the connecting rod trigger assembly, when the connecting rod trigger assembly moves from the conduction section to the disconnection section, it can ensure that the first elastic conductive connector and the second conductive connector are disconnected. Even if the first elastic conductive connector is deformed due to prolonged insertion of plug, it can be separated from the second conductive connector by moving the connecting rod trigger assembly, and its internal circuit is always in disconnected state when it is not in use.

In the safety socket provided by the embodiment, at least three insertion detection devices of the safety socket correspond to two pins of live wire and neutral wire, wherein one pin corresponds to at least two insertion detection devices, and the other pin corresponds to at least one insertion detection device. Only when all pin insertion detection signals enter the control circuit within the set time difference range, the control circuit controls the conductive connection end to be powered on, otherwise the control circuit prohibits the conductive connection end from being powered on, thus greatly improving the safety and reliability of the socket.

Figure 1:
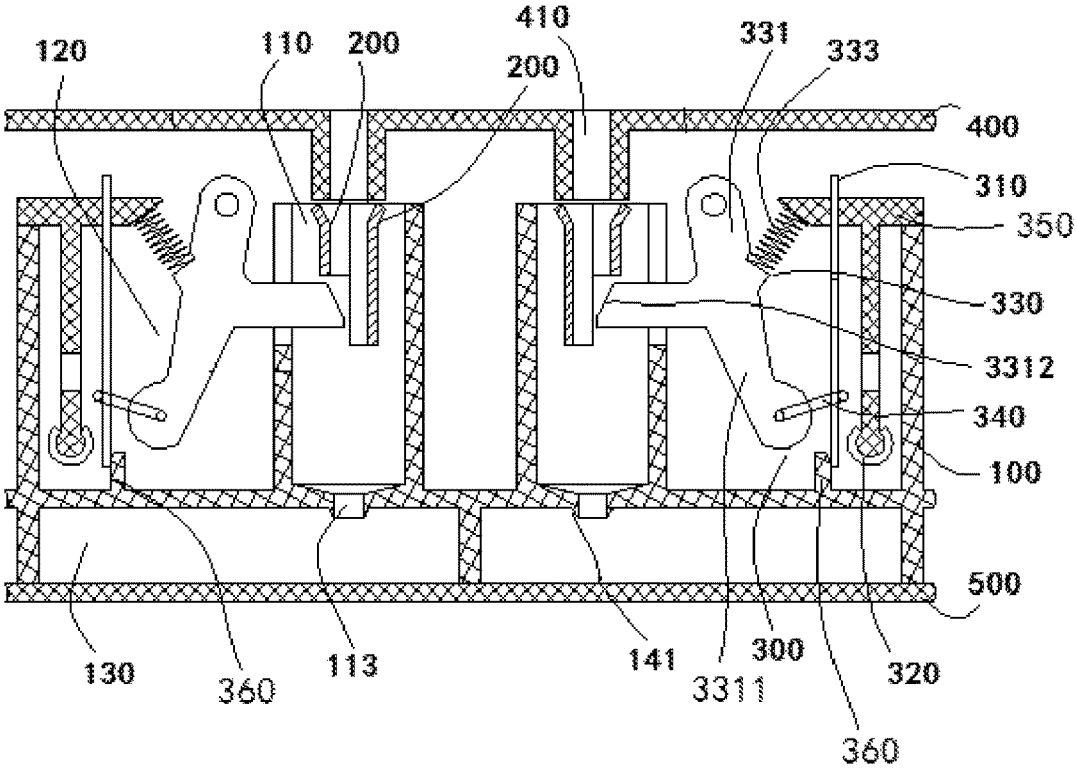
FIG. 1 is a cross-sectional view of an embodiment of the safety socket of the present application.

The reference numerals in the specification are as follows:

100. Main body frame; 110. Pin receiving cavity; 112. Liquid accumulation port; 113. Opening; 130. Liquid accumulation chamber; 141. Raised boss structure; 150. Plug chamber; 160. Light inlet window;

200. Conductive connection end;

300. Insertion detection device; 310. First elastic conductive connector; 320. Second conductive connector; 330. Connecting rod trigger assembly; 331. Connecting rod; 3311. Trigger end; 3311*a*. Shaft hole; 3312. Trigger endface; 332. Connecting rod shaft; 333. Elastic reset piece; 340. Pull-back piece; 341. Hook; 350. First elastic conductive connector bracket; 360. Retaining rebar;

400. Upper cover plate; 410. Pin-guide hole; 420. Stopper structure;

500. Lower cover plate;

600. Waterproof structure; 610. Silicone pad; 620. Silicone pad press block; 621. Pin-guide hole assembly; 622. Guide hole inclined plane (or groove); 623. Silicone placement chamber;

700. Control circuit.

DETAILED DESCRIPTION OF THE PREFERRED EMBODIMENTS

In the following, the present disclosure will be described in further detail by means of specific embodiments with reference to the accompanying drawings. Similar element in different embodiments use associate similar element numbers. In the following embodiments, many details are described in order to better explain the application. However, those skilled in the art can easily realize that some of the features may be omitted in different situations, or may be replaced by other elements, materials or methods. In some cases, some operations related to this application are not shown or described in the specification, so as prevent the core part of this application from being overlooked due to too many descriptions. However, it is not necessary for those skilled in the art to describe these related operations in detail, and they can fully understand the related operations according to the description in the specification and the general technical knowledge in the field.

In addition, the features and operations described in the specification may be combined in any suitable manner to form various embodiments. At the same time, each step or action in the method description can also be changed or adjusted in sequence in a manner obvious to those skilled in the art. Therefore, the orders in the specification and drawings are only for the purpose of clearly describing a certain embodiment and do not indicate a necessary order unless otherwise specified.

The sequence numbers assigned to parts, pieces, elements or assemblies herein, such as "first" and "second", are only used to distinguish the described objects and do not have any order or technical meanings. However, "connection" and "communication" in this application include direct and indirect connection (communication) unless otherwise specified.

In the description of the present disclosure, it should be understood that the orientation or positional relationship indicated by the terms "upper", "lower", "front", "rear", "left", "right", "vertical", "horizontal", "top", "bottom", "inner" and "outer" are based on the orientation or positional relationship shown in the drawings, only for the convenience of describing the present disclosure and simplifying the description, and do not indicate or imply that the indicated device or element must have a specific orientation, be constructed or operated in a specific orientation, and therefore cannot be understood as a limitation of the present disclosure.

Embodiment 1

The embodiment provides a safety socket having an insertion detection device for plug pins. When a plug is inserted into the safety socket, the pins of the plug trigger the insertion detection device to close the insertion detection device to form a pin insertion detection signal. The control circuit judges whether all the pin insertion detection signals enter the control circuit within the set time difference, if yes, the control circuit controls the conductive connection end to be powered on, if no, the control circuit prohibits the conductive connection end from being powered on.

Referring to FIG. 1, the safety socket includes a main body frame 100, a conductive connection end 200, a control circuit (not shown) and at least one insertion detection device 300.

Figure 2:
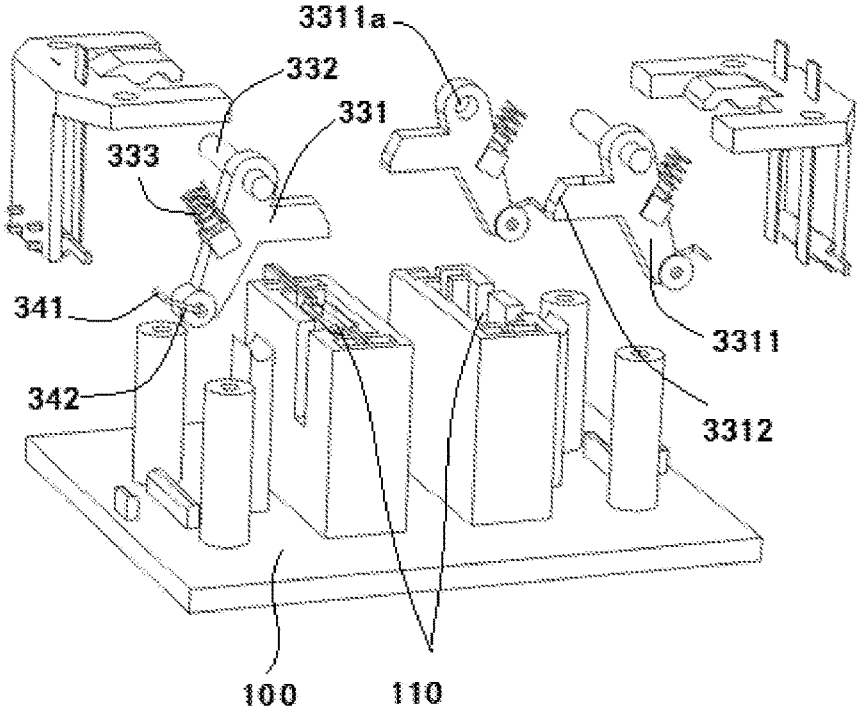
FIG. 2 is an exploded view of an embodiment of the safety socket of the present application.
Figure 3:
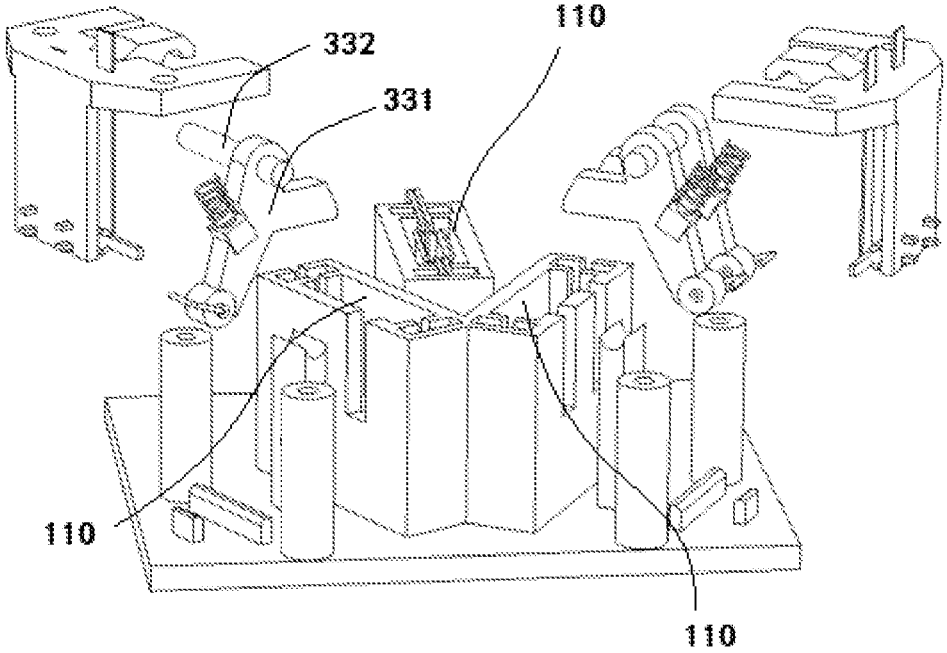
FIG. 3 is an exploded view of another embodiment of the safety socket of the present application.

Wherein, the main body frame 100 defines at least two pin receiving cavities 110 for insertion of plug pins. The number of pin receiving cavities 110 may be determined according to actual requirements. For example, in some cases, the number of pin receiving cavities 110 may be two. One of the two above-mentioned pin receiving cavities 110 is live pin receiving cavity and the other is neutral pin receiving cavity, as shown in FIG. 2. In some cases, earth pin receiving cavity can be added as needed, as shown in FIG. 3. The conductive connection end 200 is correspondingly arranged in the pin receiving cavity 110 for connection with inserted pins. The control circuit is connected to the conductive connection end 200 and controls the power-on and power-off of the conductive connection end 200.

Referring to FIG. 1, in one embodiment, the insertion detection device 300 includes a first elastic conductive connector 310, a second conductive connector 320, and a connecting rod trigger assembly 330. The connecting rod trigger assembly 330 is arranged at the main body frame 100 or other parts, has a conduction section and a disconnection section on its motion path, and is at least partially positioned on the insertion path of a pin. In the process of inserting a pin into the pin receiving cavity 110, the connecting rod trigger assembly 330 can be driven to move from the disconnection section to the conduction section. The conduction section refers to the stroke in which the connecting rod trigger assembly 330 can make the first elastic conductive connector 310 and the second conductive connector 320 come into contact, when moving in the direction of the second conductive connector 320, with the deformation of the first elastic conductive connector 310, the pressure between the first elastic conductive connector 310 and the second conductive connector 320 gradually increases. In the reverse direction, the pressure gradually decreases until they lose contact to the disconnection section.

The first elastic conductive connector 310 and second conductive connector 320 are respectively connected with the control circuit, when the connecting rod trigger assembly 330 is located in the conduction section, the second conductive connector 320 communicates with the first elastic conductive connector 310 to generate a pin insertion detection signal, and the control circuit determines whether to energize the conductive connection end 200 after receiving the signal. When the connecting rod trigger assembly 330 is located in the disconnection section, the second conductive connector 320 and the first elastic conductive connector 310 are disconnected, and the control circuit controls the conductive connection end 200 not to be powered on.

Referring to FIGS. 1-3, in one embodiment, the linkage structure includes a connecting rod 331, a connecting rod shaft 332, and an elastic reset piece 333. The connecting rod 331 is rotatably mounted on the connecting rod shaft 332, the connecting rod shaft 332 is installed on the main body frame 100, and the elastic reset piece 333 can be installed on the main body frame 100 or other components, and is connected with the connecting rod 331 to provide force for resetting the connecting rod 331.

The connecting rod 331 can rotate around the connecting rod shaft 332. At least a part of the connecting rod 331 extends into the pin receiving cavity 110 for rotating under the action of a pin when the pin is inserted, so that the connecting rod trigger assembly 330 moves from the disconnection section to the conduction section.

Because the rotational movement adopted by the connecting rod trigger assembly 330, for relative translational motion, when a plug is inserted into a socket, the pin can easily rotate the connecting rod trigger assembly 330 to connect the second conductive connector 320 and the first elastic conductive connector 310. In this process, the required thrust is small, thus reducing the extrusion between the pin and the insertion detection device 300 and reducing the wear between the pin and the connecting rod trigger assembly 330.

When the plug is pulled out of the socket, since the connecting rod trigger assembly 330 and the first elastic conductive connector 310 form a linkage structure, when the first elastic conductive connector 310 moves along with the connecting rod trigger assembly 330 and moves from the conduction section to the disconnection section, it can be ensured that the first elastic conductive connector 310 is disconnected from the second conductive connector 320, so that when the socket is not in use, the first elastic conductive connector 310 and second conductive connector 320 are always disconnected. Even if someone mistakenly connects the conductive connection end 200, the control circuit will not power on the conductive connection end 200, thus greatly improving the safety and reliability of the socket.

The linkage structure here refers to that the first elastic conductive connector 310 can move from the conduction section to the disconnection section with the connecting rod trigger assembly 330, and can also move from the disconnection section to the conduction section with the connecting rod trigger assembly 330. The displacement and stroke trace of the two movements may be the same or different. For example, referring to FIG. 1, in one embodiment, the first elastic conductive connector 310 and the connecting rod trigger assembly 330 are separated, but when the connecting rod trigger assembly 330 moves toward the conduction section, the connecting rod trigger assembly 330 will gradually approach the first elastic conductive connector 310 and finally abut against the first elastic conductive connector 310 and push it to move towards the second conductive connector 320. This method is also included in the linkage structure mentioned in this application.

It can be understood that the connecting rod trigger assembly 330 and the first elastic conductive connector 310 can form the above-mentioned linkage structure in a fixed or movable connection manner.

Further, in one embodiment, in the live pin receiving cavity and the neutral pin receiving cavity, one is correspondingly provided with at least two insertion detection devices, and the other is correspondingly provided with at least one insertion detection device.

Figure 8:
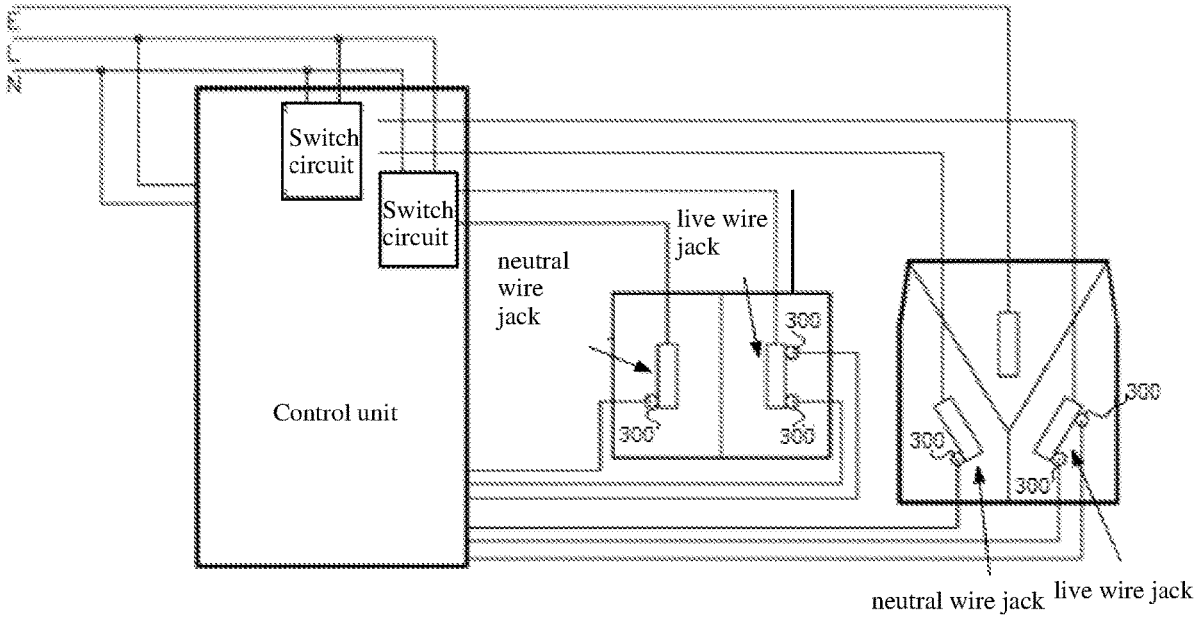
FIG. 8 is a schematic circuit structure diagram of an embodiment of the safety socket of the present application.

Referring to FIGS. 2, 3 and 8. in one embodiment, at least two insertion detection devices 300 are provided for each live pin receiving cavity (the live wire jack in FIG. 8 is live pin receiving cavity), and at least one insertion detection device 300 is provided for each neutral pin receiving cavity (the neutral wire jack in FIG. 8 is neutral pin receiving cavity).

The connecting rod trigger assembly 330 is arranged on the wider side of the pin receiving cavity 110, which not only facilitates the installation of the insertion detection device 300, but also enables the edge of wide surface of the pin to act on the insertion detection device 300. In addition, the wide surface of the pin is usually smooth, which has better surface smoothness than the narrow surface of the pin. When the wide surface of the pin contacts the insertion detection device 300, the difficulty of inserting a pin into socket can be reduced to a certain extent, the friction between them can be reduced, and the service life of the plug or socket can be prolonged.

In some specific embodiments, an insertion detection device 300 can be placed at any position along the wider side of the pin receiving cavity 110, as long as the pin can act on the insertion detection device 300 in the process of inserting the pin into the pin receiving cavity 110. Generally speaking, the insertion detection device 300 can be set at a position in the pin receiving cavity 110 where it is not easy to be touched by mistake, for example, a side of the pin receiving cavity 110, which can, to some extent, reduce the possibility of being accidentally touched by foreign matters with widths smaller than that of pins.

Referring to FIG. 8, more than two insertion detection devices 300 may be placed at the two ends of the wider side of the pin receiving cavity 110, so that there is a spacing between the insertion detection devices. Because the width of the plug pin is matched with the pin receiving cavity 110, the pin will certainly act on the two insertion detection devices simultaneously during the insertion of the pin into the pin receiving cavity 110, thereby switching on circuit. However, in the case of accidental contact, it is necessary to trigger the two or more insertion detection devices at the same time in order to be conductive. Especially, if children without safety awareness insert sharp metal pieces with a width smaller than the pin into the pin receiving cavity 110, it is not easy to contact with the two insertion detection devices 300 at the same time, thus greatly improving the safety of socket use to a certain extent.

The advantage of this is to ensure to the greatest extent that only when the plug pin is inserted, all the insertion detection devices 300 will be triggered and a signal for detecting the insert will be generated. When the inserted object is not plug pin, such as iron wire or key, since the width is smaller than the pin and it is unlikely to insert two pins at the same time, the insertion detection devices 300 will not be triggered all.

Of course, if at least one insertion detection device 300 is arranged in each live pin receiving cavity and at least two insertion detection devices 300 are arranged in each neutral pin receiving cavity, the at least two insertion detection devices 300 can also be arranged along the two edges on the wider side of the neutral pin receiving cavity, and the insertion detection device 300 arranged in the live pin receiving cavity is arranged along the wider side edge of the jack, which is another embodiment with the same effect.

For a group of hole positions, the control unit is used for detecting the insertion detection device 300 in each pin receiving cavity and judging whether it obtains a pin insertion detection signal generated by the insertion detection device 300 in the pin receiving cavity.

When the pin insertion detection signals generated by all the insertion detection devices 300 of the pin receiving cavity are detected and acquired, it is judged whether the time difference generated by these signals is smaller than a preset first time difference threshold value; otherwise, the pin receiving cavity is controlled to remain powered off.

When judging that the time difference generated by the signals is less than the first time difference threshold value, controlling the pin receiving cavity to be electrified; otherwise, the pin receiving cavity is controlled to remain powered off.

It should be noted that the time difference between the generation of two or more signals in this application refers to the difference between the times when they are generated. For example, if one signal is generated at the 1st millisecond and the other signal is generated at the 10th millisecond, their time difference is 9 milliseconds.

In one embodiment, the control unit is further configured to detect whether a signal (an inserted object being pulled out) generated by the insertion detection device 300 of the pin receiving cavity is obtained after controlling each conductive connection end 200 to be powered on; When a signal of an inserted object being pulled out generated by any insertion detection device 300 is detected, the pin receiving cavity is controlled to be powered off.

It should be noted that the above-mentioned FIG. 8 also shows a block diagram of the switch circuit, which is to make the present disclosure more clear that the control unit of the present disclosure has the function of turning on and off the energization of the pin receiving cavity, that is, it can control the power-on of the pin receiving cavity or the power-off of the pin receiving cavity.

In addition to determining whether to power on or not by judging the time difference, in some embodiments, the structure can be simplified as long as the control circuit detects that all the insertion detection devices 300 are turned on, i.e. controls each conductive connection end 200 to be powered on, this control method is a relatively mature technology and will not be described here.

Further, referring to FIG. 1, in one embodiment, it further includes a first elastic conductive connector bracket 350, the first elastic conductive connector bracket 350 is installed on the main body frame 100 of the socket. One end of the first elastic connector 310 is fixedly installed on the first elastic conductive connector bracket 350, and only relies on its own elastic deformation to form linkage with the connecting rod trigger assembly 330. At the same time, the first elastic conductive connector bracket 350 can also be used as the installation basis of the elastic reset piece 333.

Referring to FIGS. 1 and 2, in one embodiment, the elastic reset piece 333 adopts a spring. The spring is used to provide the connecting rod 331 with a force when moving from the conduction section to the disconnection section, so that the connecting rod trigger assembly 330 can return to the disconnection section after a pin is pulled out of the pin receiving cavity 110.

In some specific embodiments, the spring can be a telescopic spring, a compression spring or other spring with the same function or other elastic components.

In some specific embodiments, referring to FIGS. 1 and 2. the connecting rod 331 includes a trigger endface 3312 and a trigger end 3311. The trigger end 3311 belongs to the lower end of the connecting rod 331, and the trigger endface 3312 extends at least partially into the insertion path of the pin, so as to cause the trigger end 3311 to rotate around the connecting rod shaft 332 when the pin is inserted.

Specifically, referring to FIGS. 1 and 2, the connecting rod shaft 332 is provided on one side of the pin receiving cavity 110, one end of the connecting rod 331 is provided with a shaft hole 3311*a*, and the connecting rod 331 is sleeved on the connecting rod shaft 332 through the shaft hole 3311*a*.

The trigger end surface 3312 is disposed toward the insertion direction of the pin. In order to ensure that the connecting rod 331 can easily and stably generate rotary motion under the action of the pin, the trigger end surface 3312 is an inclined surface. Preferably, in disconnection section, the trigger end surface 3312 is located directly below the insertion direction of the pin and is disposed opposite to the insertion direction of the pin. When a pin is inserted into the pin receiving cavity 110, the top end of the pin will certainly contact the trigger end surface 3312, thereby pressing the trigger end surface 3312. Because the trigger end surface 3312 is an inclined surface, a pushing force will surely be generated to the connecting rod 331 in the extrusion process, so that the connecting rod 331 drives the trigger end 3311, and then the trigger end 3311 rotates, so that the entire connecting rod trigger assembly 330 can easily move from the disconnection section to the conduction section.

Further, referring to FIGS. 1 and 2, in one embodiment, the linkage structure further includes a pull-back piece 340 installed at the trigger end 3311, and a hook 341 formed on the side of the first elastic conductive connector 310 away from the connecting rod trigger assembly 330, when the connecting rod trigger assembly 330 moves from the conduction section to the disconnection section, the pull-back piece 340 hooks the first elastic conductive connector 310 to disconnect it from the second conductive connector 320.

Referring to FIGS. 1 and 2, in one embodiment, the pull-back piece 340 is rotatably mounted on the connecting rod trigger assembly 330. In other embodiments, the pull-back piece 340 may also be fixed on the connecting rod trigger assembly 330.

Referring to FIGS. 1 and 2, in one embodiment, the lower end of the first elastic conductive connector 310 is provided with a retaining rebar 360, when the first elastic conductive connector 310 is reset, the lower end contacts the retaining rebar 360. The retaining rebar 360 limits one side of the first elastic conductive connector 310 to avoid excessive deformation of the first elastic conductive connector 310. It can also be described as, the pull-back piece 340 cooperates with the retaining rebar 360, to prevent or correct the deformation of the first elastic conductive connector 310 when a plug is inserted for long time.

Figure 6:
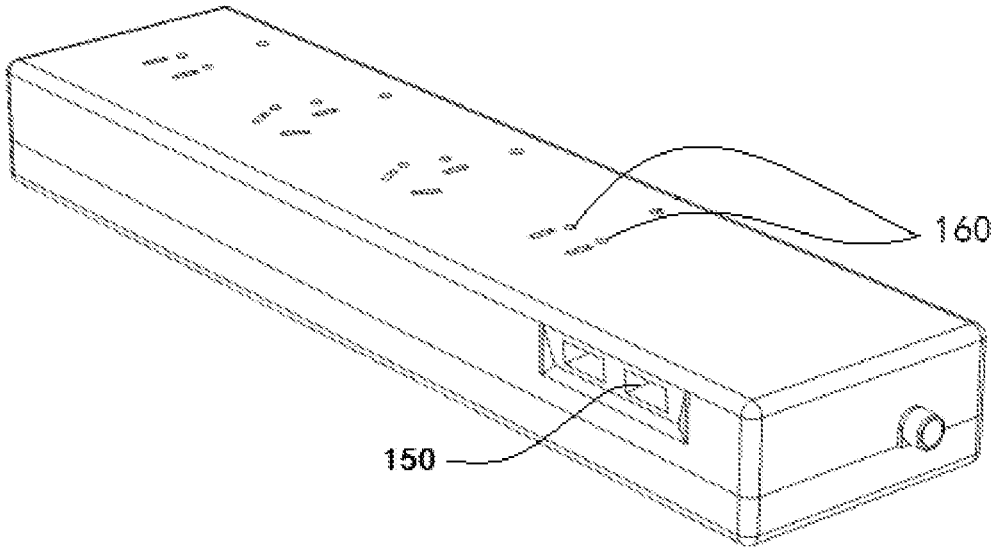
FIG. 6 is an overall appearance view of the embodiment shown in FIG. 5.

Further referring to FIG. 6. in this embodiment, in order to further improve the safety of the socket, each hole on the upper cover plate 400 of the safety socket may also be provided with at least one light inlet window 160 and a light guide piece (not shown in the figure), and the light inlet window 160 is arranged in the coverage area of a standard plug.

Further, the control unit of the safety socket further comprises a light sensor (not shown in the figure), each hole corresponds to a light sensor, the light guide piece guides the light of the light inlet window 160 to the light sensor, and the light inlet window 160 is used for detecting whether the light inlet window 160 is blocked by the standard plug.

The application does not limit the specific type or structure of the light inlet window 160, as long as it can ensure that light can enter along the light inlet window 160 from outside, for example, in some embodiments, the light inlet window 160 can be an opening arranged on the pin-guide hole side. In other embodiments, the light inlet window 160 may be a light-transmitting part disposed on the pin-guide hole side, and the light-transmitting part may be made of a transparent material, such as transparent plastic, PC, acrylic, etc.

The position and size requirements of the light inlet window 160 are that, when a plug is plugged into the socket, the plug can completely block the light inlet window 160. The light sensor detects whether the light inlet window 160 is blocked, and when the light inlet window 160 is blocked, the light sensor can generate a signal to be received by the control circuit. When all the insertion signals of the insertion detection device 300 enter the control circuit within the set first time difference, and the signal of the light inlet window 160 being completely blocked enters the control circuit within the set second time difference, plug insertion can be determined, so that the control circuit energizes the conductive connection end 200 of the hole. Otherwise, it can be determined that there is an abnormal situation, so that the conductive connection end 200 of the hole is not energized.

On the other hand, referring to FIG. 1, in one embodiment, the bottom of the main body frame 100 is also provided with a liquid accumulation chamber 130 which is in communication with the pin receiving cavity 110. The liquid accumulation chamber 130 is located below the pin receiving cavity 110. The bottom of the pin receiving cavity 110 is also provided with an opening 113 through which the pin receiving cavity 110 communicates with the liquid accumulation chamber 130. The liquid accumulation chamber 130 is used to recover the liquid entering the pin receiving cavity 110, so as to prevent the liquid from causing damage (such as short circuit and corrosion) to the structure in the pin receiving cavity 110.

In some specific embodiments, the bottom surface of the pin receiving cavity 110 is a slope inclined toward the center opening of the bottom surface, and the opening 113 is arranged at the center of the bottom surface, so that liquid can smoothly enter the liquid accumulation chamber 130 through the liquid accumulation opening 113.

Further, a water absorbing material and a desiccant can be placed in the liquid accumulation chamber 130, and once a liquid enters the liquid accumulation chamber 130, it will be absorbed by the water absorbing material or the desiccant, thus maintaining a dry environment for the pin receiving cavity 110 and further improving the use safety of the safety socket.

Further, in one embodiment, one pin receiving cavity is provided with one or more liquid accumulation chambers correspondingly, and the liquid accumulation chambers corresponding to each pin receiving cavity 110 are set separately, and the liquid accumulation chambers corresponding to different pin receiving cavities 110 are sealed from each other. In this way, it can be avoided that the liquid in the liquid accumulation chamber works as a conductive medium after the communication between the liquid accumulation chambers, which causes the short circuit of the internal structure of each pin receiving cavity 110 and has adverse effects on the safety of the socket.

Referring to FIG. 1, in one embodiment, the lower cover plate 500 is sealed below the liquid accumulation chamber 130, the lower cover plate 500 is detachably installed on the main body frame 100, and the lower cover plate 500 may be multiple, for sealing each corresponding liquid accumulation chamber 130 respectively, the lower cover plate 500 may also be an integral plate for sealing all the liquid accumulation chambers 130 of the socket.

Further, the lower cover plate 500 can be made of transparent material, so that the inside of the liquid accumulation chamber 130 can be seen through the plate, which facilitates real-time cleaning of the liquid accumulation chamber 130 or replacement of water absorbing material or desiccant.

Further, a raised boss structure 141 is provided at a position corresponding to the liquid accumulation port 112 in the liquid accumulation chamber 130. The raised boss structure 141 can prevent the liquid in the liquid accumulation chamber 130 from flowing back into the pin receiving cavity 110, thus further improving the safety of the socket during use.

Embodiment 2

The second embodiment provides another safety socket, which is different from the first embodiment in that it provides another linkage structure of connecting rod trigger assembly and first elastic conductive connector.

Figure 4:
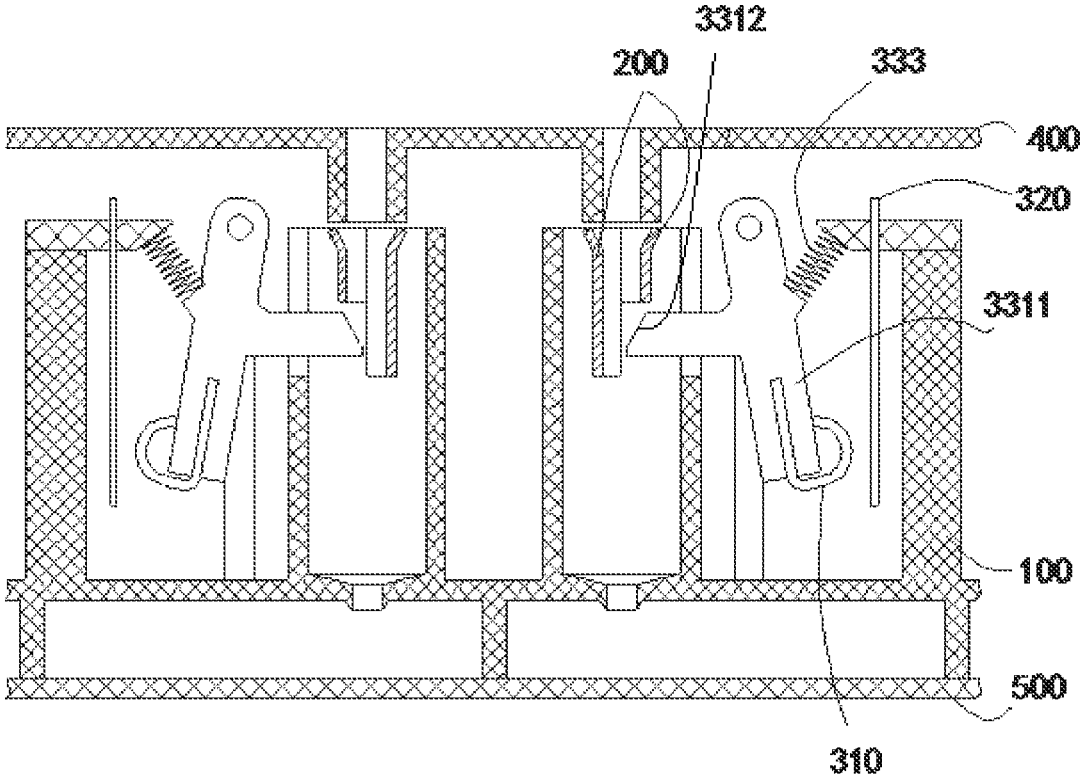
FIG. 4 is a cross-sectional view of a third embodiment of the safety socket of the present application.

Referring to FIG. 4, in this embodiment, one end of the first elastic connector 310 is fixed to the connecting rod trigger assembly 330, which moves integrally with the connecting rod trigger assembly 330. When the connecting rod trigger assembly 330 is located in the conduction section, the first elastic conductive connector 310 is in conduction with the second conductive connector 320. When the connecting rod trigger assembly 330 is located in the disconnection section, the first elastic conductive connector 310 is disconnected from the second conductive connector 320.

The structure can omit the pull-back piece 340, simplify the structure of the insertion detection device, and reduce production cost.

Embodiment 3

Figure 5:
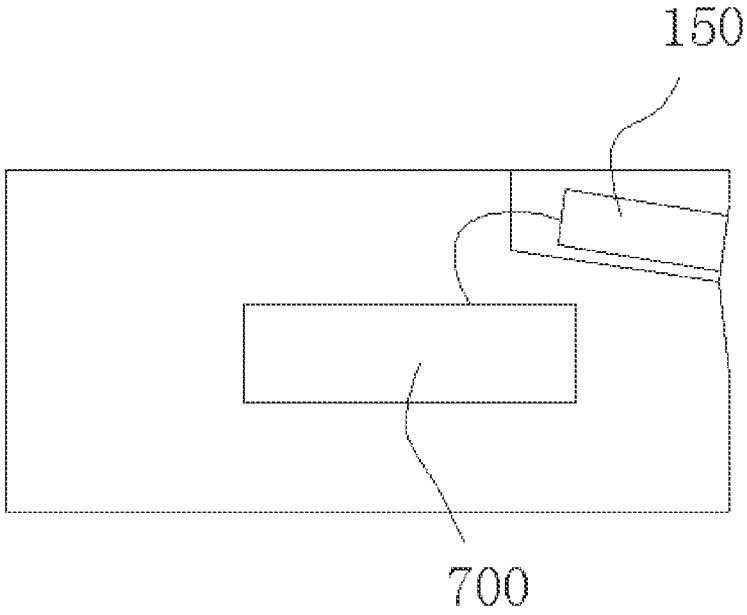
FIG. 5 is a cross-sectional view of a fourth embodiment of the safety socket of the present application.

The third embodiment provides another safety socket, which is different from the first and second embodiments in that:

referring to FIGS. 5 and 6, in order to enrich the use performance of the socket, the safety socket has at least one plug chamber 150 and a DC output connection terminal (such as a USB connection terminal) arranged in the plug chamber 150, the plug chamber 150 is obliquely arranged, and its lower end is provided with an insertion port. The obliquely arranged plug chamber 150 enables liquid to be discharged through the plug chamber 150 immediately when there is liquid in the socket.

Moreover, the DC output connection terminal can be sealed in the plug chamber 150, and is only communicated with the control circuit 700 through wires, which greatly improves the sealing performance of the plug chamber 150, because the sealing of the wire material is easier to be realizes compared with the DC output connection terminal, thereby preventing liquid or dust in the plug chamber 150 from entering the safety socket.

Embodiment 4

Figure 7:
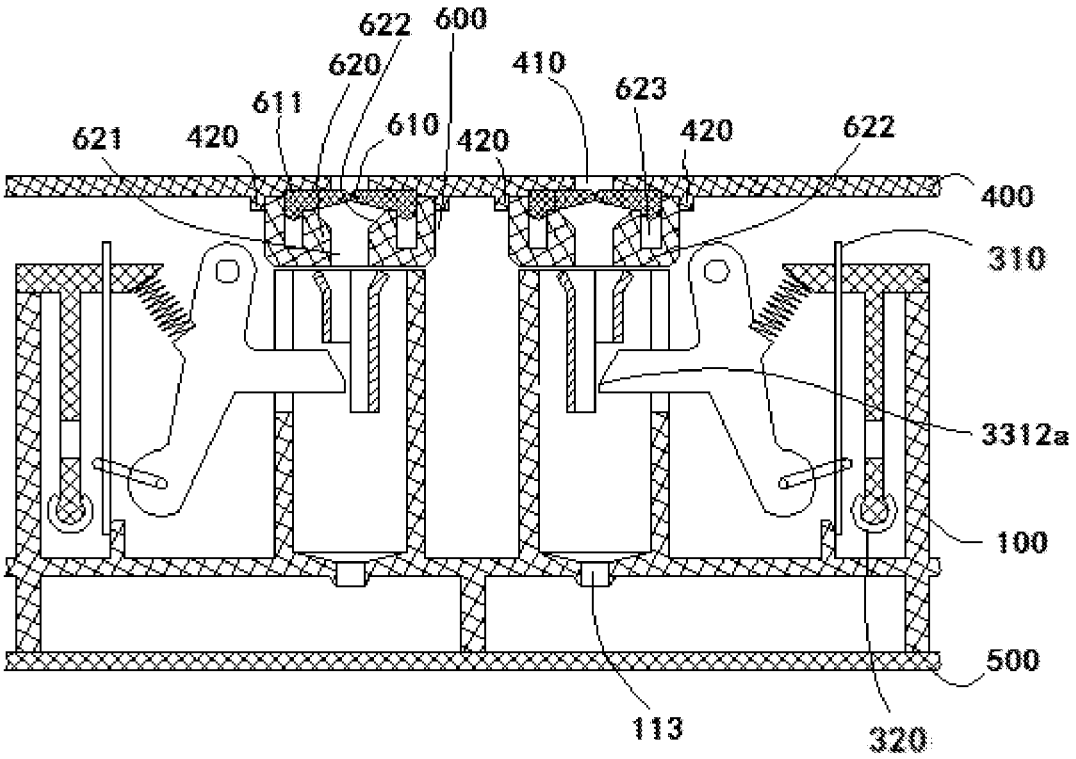
FIG. 7 is a cross-sectional view of a fifth embodiment of the safety socket of the present application.

The embodiment provides a safety socket. The structure and principle of this embodiment are basically the same as those of the safety sockets shown in Embodiments 1 and 2, except that:

Referring to FIG. 7. in this embodiment, a waterproof structure 600 is also provided between the upper cover plate 400 and the main body frame 100 for preventing liquid from entering the socket.

Referring to FIG. 7, the safety socket includes an upper cover plate 400 which is covered on the main body frame 100, and the upper cover plate 400 has a pin-guide hole 410 that interfaces with the pin receiving cavity 110. The lower surface of the upper cover plate 400 is also provided with a stopper structure 420, and the pin-guide hole 410 is located in the middle of the stopper structure 420. A waterproof structure 600 is provided between the lower surface of the upper cover plate 400 and the top surface of the pin receiving cavity 110. The waterproof structure 600 is limited between the pin receiving cavity 110 and the stopper structure 420. The waterproof structure 600 has a first state in which the pin-guide hole 410 is sealed in a free state, and a second state in which the pin-guide hole 410 leaks out due to opening under the action of an external force.

In this way, the opening and closing of the pin-guide hole 410 can be realized through the opening and closing of the waterproof structure 600. When a pin is inserted, the pin provides an external force to the waterproof structure 600, and under the action of the external force, the waterproof structure 600 changes from the closed state to the opened state. When the pin is pulled out, the waterproof structure 600 can switch from the opened state to the closed state again, thus sealing the pin-guide hole 410, further protecting the safety socket, and preventing liquid and other impurities from entering the socket, which causes damage to the socket.

In some embodiments, the stopper structure 420 is a pair of convex columns convexly arranged on the lower surface of the upper cover plate 400, and the convex columns form a limited area with the upper cover plate 400 and the top surfaces of the pin receiving cavity 110, and the waterproof structure 600 is limited inside the limited area.

In this embodiment, the waterproof structure 600 includes a pair of silicone pads 610 and silicone pad press blocks 620 for receiving the silicone pads 610, the butt joint of the silicone pad 610 is located directly below the pin-guide hole 410, for sealing the pin-guide hole 410 in a free state, the silicon pad press block 620 has a pin-guide hole assembly 621, a guide hole inclined plane 622 (or groove) and a silicone placement chamber 623 corresponding to the pin-guide hole 410 for mounting the silicone pad 610.

When no pin is inserted into the pin-guide hole 410, the pair of silicon pads 610 directly below the pin-guide hole 410 are in an initial state of sealing the pin-guide hole 410, and the silicon pads 610 are butted together at this point. When a pin is inserted, the pin can directly act on the butt joint of the silicone pad 610, thereby making the silicone pads 610 to separate from each other, and the deformed part thereof is squeezed at the gap formed by the guide hole inclined plane 622 (or groove), at this point, the pin can pass through the butt joint of the silicone pad 610. When the pin is pulled out, it is obvious that the silicone pad 610 will return to its original state with the disappearance of external force, continue to seal the pin-guide hole 410, and protect the socket.

In some specific embodiments, the silicone pad 610 is generally "L" shaped and arranged in the silicone placement chamber 623. The above-mentioned silicone pad press block 620 abuts between the lower surface of the upper cover plate 400 and the top surface of the pin receiving cavity 110. After the silicone pad 610 is installed, the silicone pad 610 can be well limited between the silicone pad press block 620 and the lower surface of the upper cover plate 400. In this way, it is beneficial to replace the silicone pad press block 620 and silicone pad 610 and ensure the long-term and efficient use of the waterproof structure.

Further, unless otherwise required by context, singular terms shall include pluralities and plural terms shall include the singular. Thus, as used herein and in the claims, the singular forms include the plural reference and vice versa unless the context clearly indicates otherwise.

The above specific embodiments is only used to help illustrate the present application and is not intended to limit the application. For those skilled in the art, more simple deductions, modifications or replacements can also be made based on the spirit of the present application.

What is claimed is:

1. An insertion detection device for plug pins in a socket, wherein the socket comprises a main body frame, and the insertion detection device is installed on the main body frame of the socket, and is characterized by comprising:

a first elastic conductive connector bracket, the first elastic conductive connector bracket is installed on the main body frame of the socket;

a first elastic conductive connector, the first elastic conductive connector is installed on the first elastic conductive connector bracket;

a second conductive connector; and a connecting rod trigger assembly including a connecting rod, a connecting rod shaft and an elastic reset piece, the connecting rod shaft is installed on the main body frame, the connecting rod is rotatably installed on the connecting rod shaft, the elastic reset piece is connected with the connecting rod to provide acting force for resetting the connecting rod; the connecting rod comprises a trigger endface and a trigger end, wherein the trigger endface is at least partially positioned on an insertion path of a pin, so that when the pin is inserted, the connecting rod is prompted to rotate around the connecting rod shaft; the trigger end has a conduction section and a disconnection section on its motion stroke, the trigger end and the first elastic conductive connector form a linkage structure, so that the first elastic conductive connector moves at least partially along with the trigger end, when the trigger end is located in the conduction section, the first elastic conductive connector is communicated with the second conductive connector, and when the trigger end is located in the disconnection section, the second conductive connector is disconnected with the first elastic conductive connector.

2. The insertion detection device of claim 1, wherein the linkage structure further comprises a pull-back piece, the pull-back piece is installed at the trigger end, and a hook, the hook is formed on the side of the first elastic conductive connector away from the trigger end, when the trigger end moves from the conduction section to the disconnection section, the pull-back piece hooks the first elastic conductive connector to disconnect it from the second conductive connector.

3. The insertion detection device of claim 2, wherein the pull-back piece is rotatably installed on the trigger end.

4. The insertion detection device for plug pins of claim 1, wherein a retaining rebar is arranged on the side of the first elastic conductive connector facing away from the second conductive connector, and the retaining rebar forms a limit on a side of the first elastic conductive connector.

5. A safety socket, comprising:

a main body frame defining a pin receiving cavity, wherein the pin receiving cavity comprises a live pin receiving cavity and a neutral pin receiving cavity, and is used for plug pins to insert;

an upper cover plate, covered on the main body frame, and the upper cover plate has a pin-guide hole corresponding to the pin receiving cavity;

a conductive connection end, correspondingly arranged in the pin receiving cavity and used for being connected with an inserting pin;

a control circuit, the conductive connection end is connected with the control circuit, and the control circuit controls the on-off of the conductive connection end; and at least three insertion detection devices of claim 1, wherein in the live pin receiving cavity and the neutral pin receiving cavity, one is correspondingly provided with at least two insertion detection devices, the other is correspondingly provided with at least one insertion detection device; a first elastic conductive connector and a second conductive connector of the insertion detection device are respectively communicated with the control circuit, and a trigger endface of a connecting rod in the insertion detection device is at least partially positioned on the insertion path of a pin, a connecting rod trigger assembly can be driven to move from the disconnection section to the conduction section in the process of inserting the pin into the pin receiving cavity, so that the first elastic conductive connector and the second conductive connector are communicated to generate a conduction signal, the conduction signal is used as a pin insertion detection signal of the control circuit; the control circuit determines whether all pin insertion detection signals enter the control circuit within a set first time difference, if yes, the control circuit controls the conductive connection end to be electrified, if no, the control circuit prohibits the conductive connection end from being electrified.

6. The safety socket of claim 5, wherein the connecting rod trigger assembly is arranged on the wider side of the pin receiving cavity, so that the edge of wide surface of the pin acts on the trigger endface of the connecting rod.

7. The safety socket of claim 5, further comprising a lower cover plate, a liquid accumulation chamber enclosed between the lower cover plate and the main body frame, and an opening arranged at the bottom of the pin receiving cavity, the bottom of the pin receiving cavity inclines to the opening, the pin receiving cavity is communicated with the liquid accumulation chamber through the opening, the lower cover plate and the main body frame are detachably installed to facilitate opening the liquid accumulation chamber.

8. The safety socket of claim 7, wherein the liquid accumulation chambers corresponding to different pin receiving cavities are sealed and separated from each other.

9. The safety socket of claim 5, further comprising a light sensor, wherein the upper cover plate of the safety socket is provided with at least one light inlet window and a light guide piece, the light guide piece guides the light of the light inlet window to the light sensor, the light inlet window is arranged in the coverage area of a standard plug, the light sensor is used for detecting whether the light inlet window is blocked, the control circuit determines whether all pin insertion detection signals enter the control circuit within a set first time difference, if no, the control circuit prohibits the conductive connection end from being powered on; if yes, it continues to determine whether the light inlet window blocked signal detected by the light sensor enters the control circuit within a set second time difference, if yes, the control circuit controls the conductive connection end to be powered on, if no, the control circuit prohibits the conductive connection end from being powered on.

10. The safety socket of claim 5, wherein the safety socket comprises at least one plug chamber and a DC output connection terminal arranged in the plug chamber, and the plug chamber is obliquely arranged to its opening; the DC output connection terminal is electrically connected with the control circuit.

* * * * *